United States Patent [19]

Zampino et al.

[11] 4,298,228

[45] * Nov. 3, 1981

[54] COMBINATION FEEDING TRAY AND PLAY TABLE

[76] Inventors: Arthur T. Zampino; Dolores V. Zampino, both of 120 Beach 19 St., Far Rockaway, N.Y. 11691

[ * ] Notice: The portion of the term of this patent subsequent to Jun. 13, 1995, has been disclaimed.

[21] Appl. No.: 971,396

[22] Filed: Dec. 20, 1978

[51] Int. Cl.[3] ..... A47D 15/00

[52] U.S. Cl. ..... 297/182; 297/135

[58] Field of Search ..... 297/182, 135, 136, 137, 297/138, 148, 153, 384, 390, 188; 46/32, 26, 29

[56] References Cited

U.S. PATENT DOCUMENTS

| | | | |
|---|---|---|---|
| 2,456,111 | 12/1948 | Creech | 297/136 |
| 2,468,856 | 5/1949 | Alexander | 297/136 X |
| 2,540,685 | 2/1951 | Mayer | 297/182 |
| 3,558,186 | 1/1971 | Shore et al. | 296/136 |
| 4,094,547 | 6/1978 | Zampino et al. | 297/182 |

*Primary Examiner*—Roy D. Frazier
*Assistant Examiner*—Peter A. Aschenbrenner
*Attorney, Agent, or Firm*—Edith T. Grill

[57] ABSTRACT

A combination feeding tray and play table adapted to be used with a chair comprising a substantially rigid, unitary tray provided with a U-shaped opening or recess of sufficient size to accomodate the body of a child, said tray comprising a horizontal surface surrounding the front and sides of said opening, integral with an upwardly and outwardly inclined sliding surface, the inner edge of said horizontal surface being provided with an upstanding perpendicular extension or border, the front portion of said horizontal surface being provided with countersunk openings for removably receiving toys and feeding plates mounted on equally sized and shaped ends adapted to frictionally fit into said openings. The back of the tray may be open or enclosed with a perpendicular upstanding backrest.

7 Claims, 8 Drawing Figures

FIG. 1
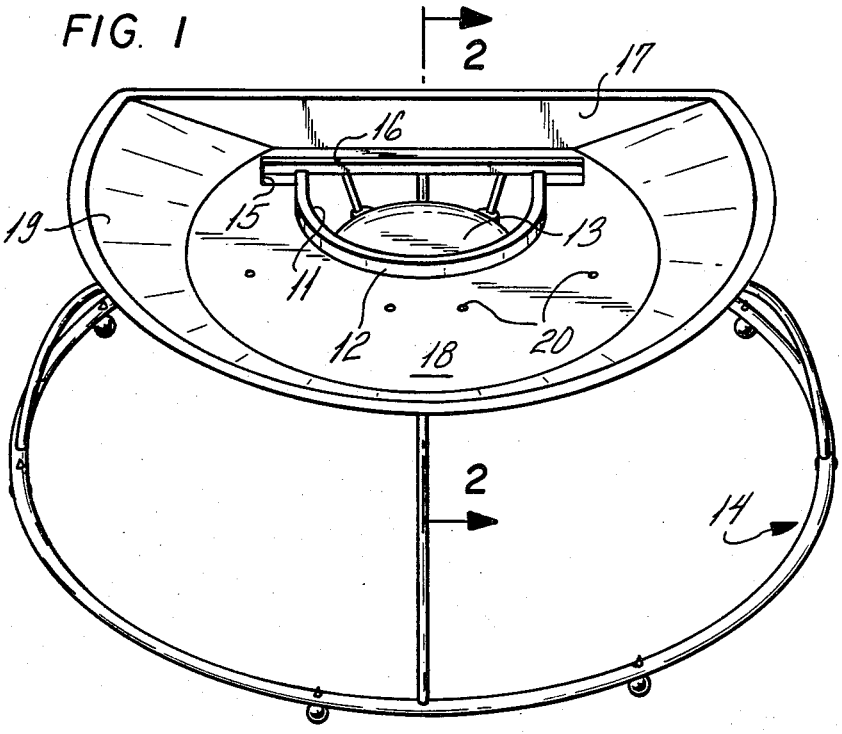
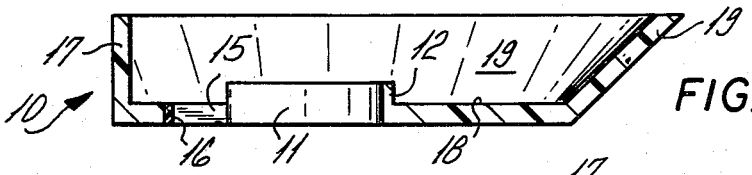
FIG. 2
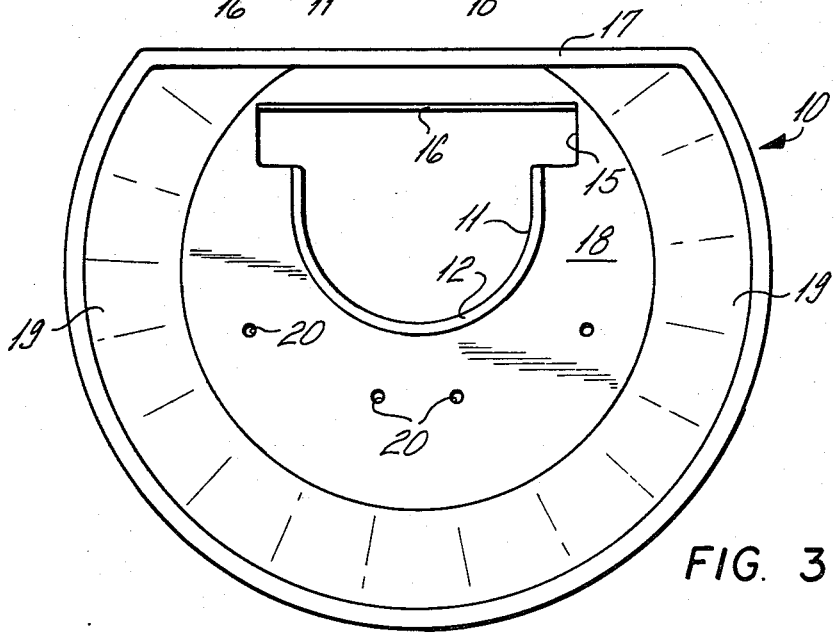
FIG. 3

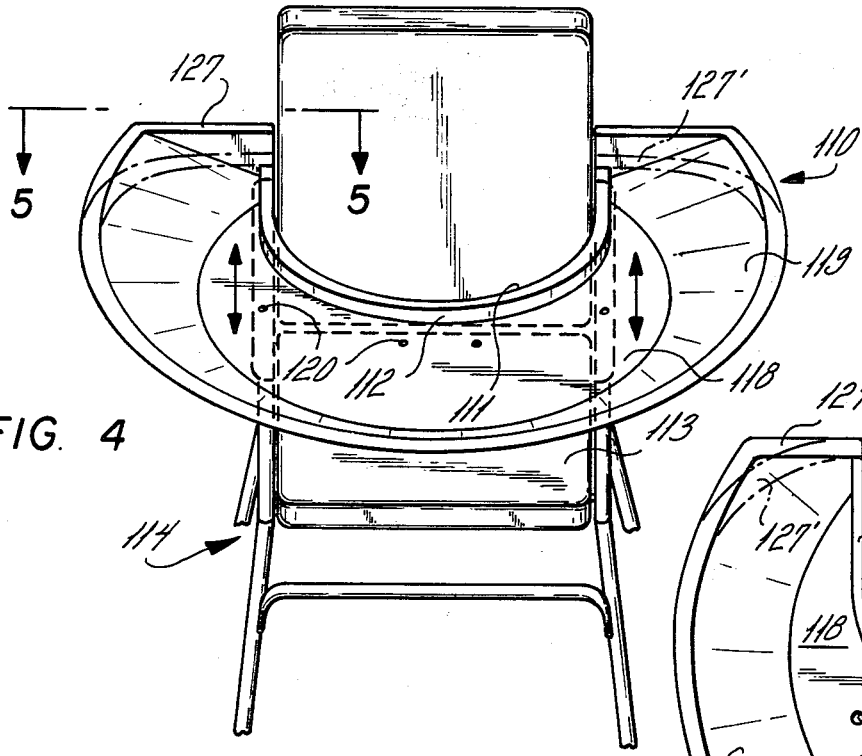
FIG. 4
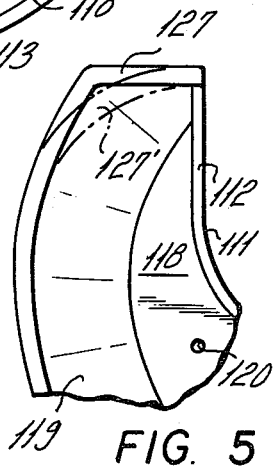
FIG. 5
FIG. 6
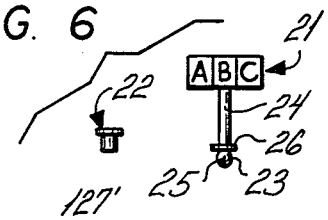
FIG. 7
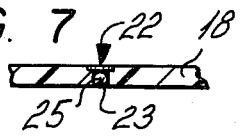
FIG. 8
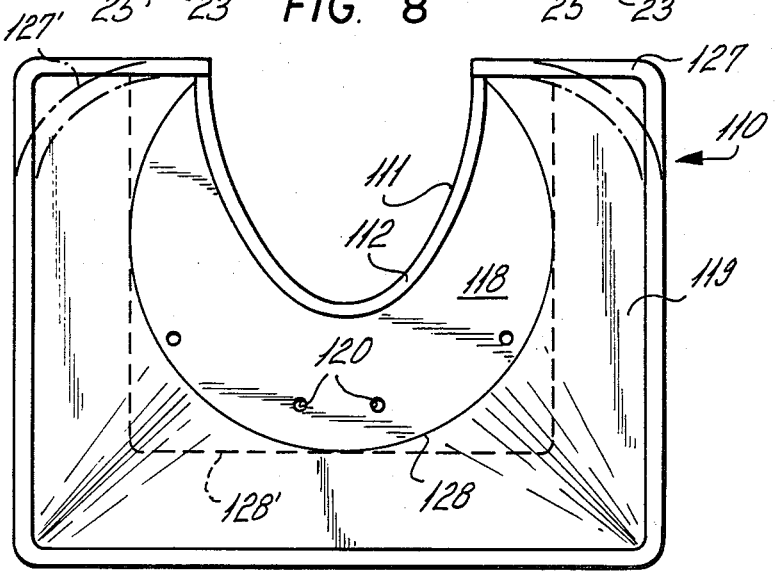

COMBINATION FEEDING TRAY AND PLAY TABLE

This invention relates to a new tray which is a combination feeding tray, and play table adapted to be mounted on and supported by the arms of a chair, high chair, walker or similar juvenile furniture, which substantially eliminates food and toys from falling onto the floor and into the seat. Instant trays are novel modifications of the trays described in our U.S. Pat. No. 4,094,547.

DESCRIPTION OF THE PRIOR ART

The prior art discloses sundry devices designed to provide toy holders and to guard an infant or small child while seated in a high chair. One such device is disclosed in U.S. Pat. No. 1,056,337 to Hurlbut, wherein playthings are secured to individual flexible connections which can be unwound and rewound on corresponding drums situated and secured to the underside of a playing board adapted to be secured to a child's high chair. Another toy holder and guard means is disclosed in U.S. Pat. No. 2,628,666 to Hall, wherein a vertical rod is attached to the outer rim of a high chair tray, the lower end of said vertical rod fitting into an opening in the high chair seat and the upper end of said rod supporting a horizontal bar from which are suspended an assortment of toys on individual strings. In addition, U.S. Pat. No. 3,213,565 to Grosz discloses a bathtub toy designed to be supported by the walls of a bathtub comprising a playing board containing apertures for receiving open ended containers, funnels and the like; and U.S. Pat. No. 3, 506,302 to House discloses a box toy provided with a horizontal board which rests on the sides of said open box and is provided with an opening to receive a cup.

The prior art also discloses attachments for high chairs which are in the form of a flexible receptacle on a wire or tubular frame, situated under the eating tray to act as a catch-all as in U.S. Pat. No. 1,050,205 to Conley and No. 2, 540,685 to Mayer; and wherein said flexible catch-all on a metal frame is attached to the legs of the high chair as in U.S. Pat. Nos. 2,827,953 to Jones and 2,938,574 to Brown. In addition, U.S. Pat. No. 1,309,343 by Thomas discloses the formation of a play table by providing a flexible apron which joins the ends of supporting arms pivotally connected to a chair.

The prior art further discloses in U.S. Pat. No. 3,558,186 to Shore et al, a stackable high chair comprising a plurality of hollow cylinders, a chair and a circular feeding tray having a peripheral rim and a rimmed central opening provided with a slot for receiving the chair.

The Zampino et al U.S. Pat. No. 4,094,547, discloses a combination bumper tray and toy holder in the shape of an oval or round tray having a U-shaped opening to accommodate the body of a child which fits over the backrest of a chair, comprising a horizontal radial surface integral with an upwardly and outwardly inclined surface, with the front portion of the horizontal surface being provided with round openings for receiving toys mounted on equally sized ball ends which fit into said openings.

Thus, it is apparent that various means have been used to amuse a young child while safely seated in a high chair, bathtub, walker, and the like without requiring the adult to constantly pick up toys from the floor.

DESCRIPTION OF THE INVENTION

However, none of these devices have the multiple advantages of the appliance of present invention which functions as a combination feeding tray and play table to prevent both toys and food from falling into the seat or onto the floor, and can be secured to juvenile furniture such as a high chair, baby walker, baby tender, car seat, swing, by conventional hardware, and can readily be substituted for the trays presently on said juvenile furniture. Instant combination tray and play table is a more compact tray than the tray disclosed in U.S. Pat. No. 4,094,547, is less costly to produce, is a space saver and has a built-in safety feature. Present novel tray is a unitary substantially rigid device which can be inexpensively produced from any suitable plastic material such as polyethylene or other resilient material or can be made out of wood or light-weight metal such as aluminum.

Present novel combination feeding tray and play table in general, is in the form of a tray whose outer edge may be round, square or rectangular preferably with rounded corners, provided with a U-shaped opening or recess of sufficient size to accommodate the body of a child, said tray comprising a horizontal surface surrounding the front and sides of said U-shaped opening to provide a support means for toys, feeding dishes and the like, the front portion thereof being provided with a suitable number of countersunk openings for removably receiving a variety of toys and feeding plates, said openings corresponding in size and shape with, and adapted to receive the similarly sized and shaped ends of a snap-in toy or plate, said horizontal surface being provided with a perpendicular upstanding extension or border at its inner edge which prevents objects from falling into the seat; and a continuous sliding member pitched or sloped upwardly and outwardly which functions as a slide for thrown objects, integral and contiguous with said horizontal support means. The horizontal support means functions as a playboard and eating tray, with the toys being situated within the grasp of the child. Said upwardly and outwardly inclined surface functions as a retrieval zone for objects tossed or dropped by the child which slide down said inclined surface back onto said horizontal surface. The inner perpendicular border which may be about ¼ to 4 inches high functions to prevent food or toys from dropping into the seat. The size of the opening can be adjusted to the size of the child by conventional known means, such as by sliding the tray, which is mounted onto the arms of a chair, towards or away from the seated child.

The tray is additionally provided with snap-in toys made out of suitable plastic and comprises a toy such as a bell, rattle, horn, doll, block, spinning wheel, clown, and the like mounted on a stem which terminates in a suitably shaped end adapted to be inserted into the openings on the horizontal support means of the tray. The feeding plate may be similarly provided with at least one suitably shaped end such as a ball end on its undersurface to enable it to be inserted into said openings. These toys are called snap-in toys because of the ball end of the toy which can readily be snapped into and out of the openings by an adult, but not by a small child. Although rounded ball ends which frictionally fit into rounded openings is preferred, oval, square or rectangular ends to frictionally fit into the correspondingly shaped openings may also be used. The countersunk openings must correspond in size and shape with the ends on the toys or feeding plate.

More specifically, instant invention provides for a combination feeding tray and play table adapted to be mounted on a chair-like device which comprises a substantially rigid unitary tray provided with a U-shaped opening or recess bordered by an upstanding substantially perpendicular extension, and of sufficient size to accommodate the body of a child, said tray comprising a horizontal surface integral with an upwardly and outwardly inclined sliding surface of substantially equal depth in its entirety, surrounding the front and sides of said bordered opening or recess, said horizontal surface being provided with countersunk openings for removably receiving toys and feeding plates mounted on equally sized and shaped ends adapted to frictionally fit into said openings. The back of the tray may be open or closed by means of a backrest.

The open-back tray is preferably secured to the arms of a high chair by means of conventional hardware attached to the undersurface of the horizontal surface of said tray, the size of the U-shaped opening being readily adjustable to the body size of the child by sliding the tray towards or away from the child as with conventional high chair trays. Although this open-back tray has been described in connection with a high chair, it may also be mounted on and secured to a baby walker, a stroller, baby tender, car seat, child's chair, invalid's chair or the like.

The closed-back tray is preferably secured to a baby walker by means of conventional hardware, with the backrest of said closed-back tray, fitting over the back of the seat. Since this U-shaped opening is not adjustable to the size of the child's body, said U-shaped opening surrounding the child is made smaller and is widened at its straight edge to resemble the head of a T-bar, in order to fit over the backrest of a chair. The back-enclosed tray provides additional stability to the walker, and provides a backrest which protects the back and head of the child. The depth of the front and sides of the tray acts as a bumper guard to protect the child's hands from being injured when colliding with walls, sharp corners, furniture or other objects. Although this closed-back tray with the head widened U-shaped opening has been described in connection with a walker, it may also be mounted and secured to a high chair, child's chair, car seat, baby tender, invalid's chair and the like.

Therefore, it is a principal object of this invention to provide a unitary combination eating tray and play table having the multiple functions of a feeding tray, toy holder and object retriever, capable of being mounted on baby or juvenile chair-like furniture.

Another object of this invention is to provide a support for snap-in toys which cannot be removed from said support by the child, but is readily removable therefrom by an adult.

Another object of this invention is to provide a safe and convenient means for keeping toys and other objects within the reach of a child and prevent them from falling to the floor.

Still another object of this invention is to provide a variety of interchangeable toys for the continued amusement of the child.

Still another object of this invention is to provide a tray which prevents food and toys from falling into the seat or onto the floor.

Still a further object of this invention is to provide a closed or open backed tray for mounting on high chairs, baby walkers and other juvenile furniture.

In accordance with the above objects and such other objects and features which will become apparant from the following specification, the invention will be understood from the accompanying drawings, wherein like characters designate like parts and wherein:

FIG. 1 is a perspective view of the combination feeding tray and play table of instant invention with a closed back mounted on a baby walker;

FIG. 2 is a side view partly in cross section, with cross section taken along lines 2—2 of FIG. 1;

FIG. 3 is a top plan view of instant closed-back tray;

FIG. 4 is a perspective view of instant tray with an open back, mounted on a high chair;

FIG. 5 is a top plan view taken along lines 5—5 of FIG. 4;

FIG. 6 is a front sectional view of a snap-in toy and the plug for the countersunk openings, in accordance with instant invention;

FIG. 7 is a fragmentary cross sectional view of the horizontal surface of instant tray provided with a countersunk opening; and FIG. 8 is a modified square shaped open-backed tray according to instant invention.

Referring to the drawings in detail, the combination feeding tray and play table of this invention comprises a tray 10 provided with a U-shaped opening 11, and an upstanding perpendicular extension or border 12 of sufficient height, about $\frac{1}{4}$ to 4 inches and preferably 1–2 inches high, at said U-shaped opening 11 to prevent toys and food from falling into seat 13 of baby walker 14. The size of U-shaped opening 11 is sufficient to accommodate the body of a child, but preferably not excessively large so that border 12 can effectively function as a barrier against spillage and to prevent articles from falling into the seat, without interfering with the child's movements.

Accordingly, the back-enclosed version of instant tray illustrated by FIGS. 1–3, wherein the U-shaped opening is not adjustable to the size of the child, is provided with a smaller U-shaped opening 11 to more effectively enclose the body of the child, which is enlarged or widened at the straight edge thereof, by an elongated horizontal opening 15 which resembles the head of a T-bar, to fit over the backrest 16 which extends upwardly from seat 13 as shown in FIG. 1. The back of tray 10 is enclosed by means of an upstanding perpendicular backrest 17 which may fit flush (not shown) with the backrest 16 of a child's chair or be slightly set back as shown in FIG. 2.

Tray 10 further comprises a horizontal surface 18 integral with an upwardly and outwardly inclined sliding surface 19 of equal depth in its entirety which surrounds U-shaped opening 11 provided with border 12.

Horizontal surface 18 which functions as a support means for toys and feeding plates and the like is provided with a plurality of countersunk openings 20 for removably receiving snap-in toys 21, after removal of plugs 22 therefrom, said toys having a configuration adapted to be received and supported in openings 20 and positioned within the child's grasp. Countersunk openings 20 which are provided with resilient plugs 22, are a safety feature to prevent finger entrapment. Plugs 22 are removed from said openings and are replaced by toys. When not in use, the plugs 22 are reinserted to avoid possible injury to the child's fingers resulting from finger entrapment. Openings 20 are preferably round, as shown, and sized, (such as about ¾ inch in diameter) to accommodate the ball end 23 of the toys. Although round openings are preferred, said openings and the ends on the toys may also be square, oval, rectangular or triangular. The plug 22 fits flush with horizontal surface 18, as shown in FIG. 7, and may be provided with a similarly shaped and sized ball end to facilitate its removal by pushing up on end 23. However, plug 22 need not have an end, but be in the shape of a simple plug. The positioning of openings 20 on horizontal surface 18 and the number of openings 20 is a matter of choice and convenience.

Snap-in toys 21 are mounted on a stem 24 which may be rigid, semi-rigid or flexible, and which terminates in preferably a rounded or oval ball 23 adapted to frictionally fit into sized openings 20. These toys in its entirety are preferably made out of resilient plastic and the ball end 23 is easily snapped into and out of openings 20 by adults, similarly to the action of poppits. End 23 may optionally be provided with a slit 25, centrally located, to facilitate insertion into and removal from openings 20. After the end 23 is inserted, it spreads apart due to slit 25 and acts as a wedge within openings 20 to more firmly engage said toy or feeding plate, which may also be mounted on an end coinciding with the shape and size of said openings, (not shown) to horizontal surface 18. When a pulling action is exerted on the end 23 to remove it from opening 20, slit 25 permits end 23 to contract for easy removal. Stopper 26 situated directly above the end 23 holds the toy erect after it is inserted into openings 20 and permits the child to grasp and play with the toy. In addition, stopper 26 prevents the removal of the toys from the tray by the child. In order to remove the toys from opening 20, stopper 26 must first be removed prior to exerting a pulling action on the toy. The resilience of ball 23 permits its extraction from sized openings 20. Similarly, the application of a pushing pressure enables the insertion of end 23 into openings 20. This action can best be characterized as a snap-in and out action. Stopper 26 is suitably shaped, to fit into opening 20 and fits either flush with the upper surface of horizontal surface 18 or may protrude above the upper surface thereof.

Accordingly, this horizontal support means functions as a playboard and toy holder. With the toys removed or in place, said support means 18 also functions as a feeding tray. Although the dimensions of this combined eating and play area 18 is variable, it is preferred to be about 5 to 8 inches deep so that it can afford a suitable area for eating and/or playing and is adapted to fit on conventional high chairs or similar baby furniture as shown in FIGS. 1 and 4.

Upwardly and outwardly inclined sliding surface 19, which may be outwardly sloped at an angle of about 100°–160° and preferably 120°–150°, is contiguous with said horizontal surface 18, said upwardly and outwardly inclined surface 19 being of substantially equal depth in its entirety, and of sufficient depth to prevent the toys from falling to the floor and to enable said toys to slide back down said incline onto said horizontal surface 18, about 4–9 inches deep and preferably about 5 to 8 inches deep. This sliding surface 19 functions as a retriever for any articles dropped or thrown by the baby, said articles simply sliding back down the incline onto the horizontal playboard area 18 where the baby can reach them and again pick them up. The advantages of this feature is self-evident to baby sitters and parents.

The open-back tray 110 which is shown mounted on the arms of a high chair 114 in FIG. 4 is provided with a U-shaped opening 111, which is adjustable to the size of the child by simply moving the tray 110 towards or away from the child. Similarly to the closed-back tray, open-back tray 110 is provided with an upstanding perpendicular border 112 at said U-shaped opening 111, to prevent food and toys from falling into seat 113 of high chair 114, and a horizontal surface 118 integral with an upwardly and outwardly inclined sliding surface 119 of substantially equal depth in its entirety. The rear edge of tray 110 may be a straight edge 127 or a rounded edge 127' as more particularly shown in FIG. 5. Horizontal surface 118 is similarly provided with countersunk openings 120 for receiving toys 21 and feeding plates (not shown) mounted on ends 23 sized and shaped to conform with the size and shape of openings 20.

Another modification of the open-back tray is shown in FIG. 8, wherein tray 110 is square or rectangular with rounded corners, rather than round as shown in FIGS. 1, 3 and 4. The junction 128 of horizontal surface 118 and the sliding surface 119 may likewise be modified to be either round 128 or square 128' as shown by the dotted lines in FIG. 8. Thus, it is apparent that the overall shape of the tray in accordance with this invention, is merely a matter of choice depending on aesthetics, just so long as the essential elements of the tray are present.

It will be readily appreciated that with this combination feeding tray and play table attached to a high chair, walker or other chair-like juvenile furniture, amusing a small child is simplified and the picking up of toys thrown to the ground and falling into the seat is substantially eliminated. The inclined surface of instant novel tray is effective in retrieving thrown or dropped objects, thereby providing the child with a continuous source of objects for holding and playing. The inner border around the U-shaped opening is an additional deterrant to the loss of toys. In addition the snap-in toys which remain affixed to the horizontal surface of the tray provides the child with an assortment of toys which he can continuously handle and play with, without losing them. The countersunk openings on the tray provide for a safe playing and eating surface. In addition, if the novel tray of this invention is mounted on a walker, the child's limbs are safely within the confines of the tray, thereby preventing danger to himself when he collides with corners of furniture, hot stoves, radiators, and the like, as he learns to walk.

The combination tray and play table of present invention is also useful and can be attached to chairs for invalids such as wheelchairs and the like to provide a combined playboard and eating tray. Consequently, the combination tray of present invention can be supported by the arms of any chair and be attached to any chair to provide a combined playboard and eating tray.

Present combination tray is substantially rigid and can be inexpensively and simply manufactured by molding as a unitary unit from a suitable resilient plastic material. Instant unitary tray is designed to be mounted and attached to a chair by means of conventional hardware which is secured to the underside of the tray using the arms of a chair as the support therefor, or it can rest on the eating tray of a high chair. Accordingly, instant novel tray can be substituted for the eating tray of a high chair or the like, or it can merely be superimposed thereon as a temporary measure.

Although this invention has been described with reference to specific embodiments, it will be apparent to one skilled in the art that various modifications and equivalents may be made thereto which fall within the scope herein.

I claim:

1. A combination feeding tray and play table adapted to be mounted on a chair-like device which comprises a substantially rigid unitary tray provided with a U-shaped opening or recess of sufficient size to accommodate the body of a child, said tray comprising a horizontal surface integral with an upwardly and outwardly inclined sliding surface of substantially equal depth in its entirety, surrounding the front and sides of said opening or recess, said horizontal surface being provided at its inner edge adjacent said U-shaped opening with an upstanding substantially perpendicular extension of sufficient height to prevent toys and food from falling into the seat of said chair-like device, said horizontal surface being additionally provided with counter-sunk openings for removably receiving toys and feeding plates mounted on equally sized and shaped ends adapted to frictionally fit into said openings.

2. A tray in accordance with claim 1, wherein the back of the tray is open.

3. A tray in accordance with claim 2, wherein the U-shaped opening is adjustable to the body size of the child.

4. A tray in accordance with claim 1, wherein the back of the tray is enclosed by means of a perpendicular upstanding backrest, which fits over the back of said chair-like device.

5. A tray in accordance with claim 4, wherein the U-shaped opening is widened at the straight edge of the U to fit over the backrest of the chair.

6. A tray in accordance with claim 1, wherein the upwardly and outwardly inclined sliding surface is of sufficient depth to prevent the toys from falling to the floor, and to enable said toys to slide back down said incline onto said horizontal surface.

7. A tray in accordance with claim 1, wherein the countersunk openings are provided with resilient removable plugs.

* * * * *